US007506684B2

(12) United States Patent
Wanni et al.

(10) Patent No.: US 7,506,684 B2
(45) Date of Patent: Mar. 24, 2009

(54) ANTI-VIBRATION TUBE SUPPORT WITH LOCKING ASSEMBLY

(75) Inventors: Amar S. Wanni, Falls Church, VA (US); Thomas M. Rudy, Warrenton, VA (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 0 days.

(21) Appl. No.: 11/812,562

(22) Filed: Jun. 20, 2007

(65) Prior Publication Data

US 2008/0315047 A1 Dec. 25, 2008

(51) Int. Cl.
*F28D 7/00* (2006.01)

(52) U.S. Cl. ..... 165/162; 248/49; 248/68.1; 248/75

(58) Field of Classification Search ..... 248/68.1, 248/49, 58, 75, 79, 80, 89; 138/106; 165/162
See application file for complete search history.

(56) References Cited

U.S. PATENT DOCUMENTS

| | | | |
|---|---|---|---|
| 3,420,297 | A | 1/1969 | Romanos |
| 3,637,008 | A | 1/1972 | Eberhard et al. |
| 3,820,594 | A | 6/1974 | Ritland et al. |
| 3,998,268 | A | 12/1976 | Sagan |
| 4,185,802 | A | 1/1980 | Myles et al. |
| 4,447,942 | A | 5/1984 | Jabsen |
| 4,685,511 | A | 8/1987 | Sabatino |
| 4,709,756 | A | 12/1987 | Wilson et al. |
| 4,789,028 | A | 12/1988 | Gowda et al. |
| 4,874,041 | A | 10/1989 | Crick et al. |
| 4,895,204 | A | 1/1990 | Johnson et al. |
| 4,919,199 | A | 4/1990 | Hahn |

(Continued)

FOREIGN PATENT DOCUMENTS

EP 0 134 012 A 3/1985

OTHER PUBLICATIONS

International Search Report, PCT/US2008/007728, mailed Oct. 28, 2008.

(Continued)

*Primary Examiner*—Ramon O Ramirez
(74) *Attorney, Agent, or Firm*—Glenn T. Barrett

(57) ABSTRACT

A support device for a bundle of elongated members and a locking assembly for securing the same within the bundle are disclosed. The support device includes an elongated support adapted to be located between adjacent spaced rows of elongated members, wherein the elongated support having a first side and a second side, wherein the first side being arranged to be positioned adjacent one row of the spaced rows of elongated members and the second side being arranged to be positioned adjacent another row of the spaced rows of elongated members. The support device includes a plurality of support members spaced along the elongated support, wherein each support member have a first supporting assembly located on the first side for supporting one of the elongated members in the one row and a second supporting assembly located on the second side for supporting one of the elongated members in the other row. At least one locking assembly is provided for locking the support device between the adjacent rows of elongated members, wherein each of the at least one locking assembly being located on at least one of the first side and the second side between adjacent supporting assemblies.

13 Claims, 2 Drawing Sheets

U.S. PATENT DOCUMENTS

| | | | | |
|---|---|---|---|---|
| 4,960,253 | A * | 10/1990 | Perrault et al. | 248/68.1 |
| 5,072,786 | A | 12/1991 | Wachter | |
| 5,515,911 | A | 5/1996 | Boula et al. | |
| 5,613,655 | A * | 3/1997 | Marion | 248/68.1 |
| 6,059,022 | A | 5/2000 | Wilson | |
| 6,997,141 | B2 | 2/2006 | Sun | |
| 7,032,655 | B2 * | 4/2006 | Wanni et al. | 165/162 |
| 7,073,575 | B2 | 7/2006 | Wanni et al. | |
| 7,128,130 | B2 * | 10/2006 | Wanni et al. | 165/69 |
| 7,267,164 | B2 * | 9/2007 | Wanni et al. | 165/162 |
| 2005/0098688 | A1 * | 5/2005 | Miarka et al. | 248/68.1 |
| 2005/0279487 | A1 | 12/2005 | Wanni et al. | |
| 2006/0070727 | A1 | 4/2006 | Wanni et al. | |
| 2006/0108106 | A1 * | 5/2006 | Rudy et al. | 165/162 |
| 2006/0151150 | A1 | 7/2006 | Wanni et al. | |
| 2006/0162913 | A1 | 7/2006 | Wanni et al. | |

OTHER PUBLICATIONS

Written Opinion, PCT/US2008/007728, mailed Oct. 28, 2008.

* cited by examiner

ANTI-VIBRATION TUBE SUPPORT WITH LOCKING ASSEMBLY

FIELD OF THE INVENTION

This invention relates to support devices for supporting elongated members. In particular, the present invention relates to support devices for use in connection with tube bundles in heat exchangers and similar fluid-handling equipment to reduce vibration of the tubes within the tube bundle. The support devices in accordance with the present invention include at least one locking assembly to prevent unintentional removal of the support devices once installed in the tube bundle.

BACKGROUND OF THE INVENTION

Shell and tube heat exchangers and similar items of fluid handling devices utilize tubes organized in bundles to conduct the fluids through the equipment. In such tube bundles, there is typically fluid flow both through the insides of the tubes and across the outsides of the tubes. The configuration of the tubes in the bundle is set by the tubesheets into which the tubes are set. One common configuration for the tubes is a square formation with the tubes set in aligned rows with tube lanes (the straight paths between the tubes) between each pair or rows, aligned orthogonally to one another. This configuration is illustrated in FIG. 1 in connection with the tube support device and locking assembly in accordance with the present invention. In this formation, each tube is adjacent to eight other tubes except at the periphery of the tube bundle and is directly opposite a corresponding tube across the tube lane separating its row from the two adjacent rows. In the triangular tube formation, the tubes in alternate rows are aligned with one another so that each tube is adjacent six other tubes (the two adjacent tubes in the same row and four tubes in the two adjacent rows).

Fluid flow patterns around the tubes as well as the changes in the temperature and density of the fluids which arise as a result of the heat exchange between the two fluids flowing in and around the tubes may give rise to flow-induced vibrations of an oscillatory nature in the tube bundle. If these vibrations reach certain critical amplitudes, damage to the bundle may result. Tube vibration problems may be exacerbated if heat exchange equipment is retubed with tubes of a different material to the original tubes, for example, if relatively stiff materials are replaced with lighter weight tubes. Flow-induced vibration may also occur when equipment is put to more severe operating demands, for example, when other existing equipment is upgraded and a previously satisfactory heat exchanger, under new conditions, becomes subject to flow-induced vibrations. Vibration may even be encountered under certain conditions when an exchanger is still in the flow stream but without heat transfer taking place.

Besides good equipment design, other measures may be taken to reduce tube vibration. U.S. Pat. No. 7,032,655 to Wanni et al., U.S. Pat. No. 7,117,935 to Wanni et al., and U.S. Pat. No. 7,128,130 to Wanni et al. disclose various tube support devices that effectively mitigate flow-induced vibration in tube bundles. These tube support devices utilize elongated members that are adapted to be received within tube lanes to engage adjacent tubes and effectively reduce vibration to improve operation.

Co-pending U.S. patent application Ser. No. 11/128,884 to Wanni et al., also discloses another tube support device, the disclosure of which is hereby incorporated in its entirety specifically by reference. This tube support device is also effective in mitigating vibration within the tube bundle to improve operation. With reference to FIG. 1, the tube support device 10 comprises an elongated flat member made up of two strips 11, 12 that are connected together back-to-back by welds or other suitable connection means. The tube support devices 10 are configured to be inserted in the tube lanes. The support devices may be inserted within each tube lane, alternating tube lanes or at locations sufficient to mitigate vibration. The tube support device 10 includes a plurality of support members 13, 14 that engage adjacent tubes 1. The support members 13, 14 are created on the face of the two strips 11, 12. Each support member has a plurality of arcuate tube-receiving saddles 15, which are sized to receive a portion of the tubes therein. The tube support devices may be secured in place by passing a cable through the ends of the support devices 10 and around the bundle.

While the cables are effective in securing the support devices within the bundle, the use of such cables has potential drawbacks. There may be difficulties associated with installing the cable around the tube bundle. The cable may fret at the point where the cable passes through an associated aperture in the support device, which could lead to the potential failure of the cable. Additionally, the flow of fluid around the tubes of the tube bundle may cause the cable to rub on the outer surface of the outermost tubes in the tube bundle, which may cause wear.

There is a need for a locking assembly for securing a tube support device in a desired location within the tube bundle that does not cause wear to the locking assembly, the tube support device and/or the tube bundle.

SUMMARY OF THE INVENTION

It is an aspect of the present invention to provide a support device for a bundle of elongated members having locking assembly that maintains the support device in proper orientation within the bundle while preventing accidental removal of the support device.

In accordance with the principles of the present invention, a support device for a bundle of elongated members is provided. The bundle of elongated members includes a plurality of spaced rows of elongated members. The bundle may have a square tube pattern configuration, either 90 or 45 degree layout. The bundle of elongated members having an interior and an outer periphery. The support device includes an elongated support adapted to be located between adjacent spaced rows of elongated members. Each elongated support is preferably formed from a pair of metal strips that are selectively secured together. The elongated support having a first side and a second side. The first side being arranged to be positioned adjacent one row of the spaced rows of elongated members and the second side being arranged to be positioned adjacent another row of the spaced rows of elongated members. The elongated support having a plurality of support members spaced along the elongated support. Each support member has a first supporting assembly located on the first side for supporting one of the elongated members in the one row and a second supporting assembly located on the second side for supporting one of the elongated members in the other row. The plurality of support members are preferably spaced along substantially the entire length of the elongated support. The supporting assemblies engage the elongated members within the bundle to stabilize the elongated members and thus reduce vibration when fluids flow through and around the elongated members at higher velocities.

In order to maintain proper orientation of the support devices within the bundle of elongated members and prevent removal of the same, the support device further includes at least one locking assembly for locking the support device between the adjacent rows of elongated members. The locking assembly prevents inadvertent removal after the support device has been properly oriented within the bundle of elongated members. Each locking assembly is located between adjacent supporting assemblies. Each locking assembly is sized to contact adjacent elongated members in the same row of elongated members in the bundle, which prevents the displacement of the support device with respect to the bundle of elongated members. Preferably, the locking assembly having a thickness that is greater than the thickness of the supporting assemblies. Each locking assembly may extend from opposing sides of the elongated supports. It is also contemplated that the locking assembly may extend only from a single side of the elongated support such that the locking assembly contacts the adjacent elongated members on only one side of the support.

While it is contemplated that the supporting assemblies are spaced along substantially the entire length of the support device, the locking assemblies are intended to be located between supporting assemblies that are located near the outer periphery of the bundle. This arrangement of locking assemblies is sufficient to ensure that the support devices are properly maintained within the bundle of elongated members.

In accordance with an embodiment of the present invention, each locking assembly includes a locking block having a slot formed therein. The slot is sized to receive a portion of the elongated support therein. The locking block is preferably formed from metal. The locking block may be formed as a cast component or a strip of metal that is bent to form a generally U-shape. The locking block preferably contains rounded edge surfaces to prevent damage to the elongated members contacted the locking assembly.

BRIEF DESCRIPTION OF THE DRAWINGS

The invention will now be described in connection with the following drawings in which like reference numerals designate like elements and wherein.

DETAILED DESCRIPTION OF EMBODIMENTS OF THE INVENTION

Figure 1:
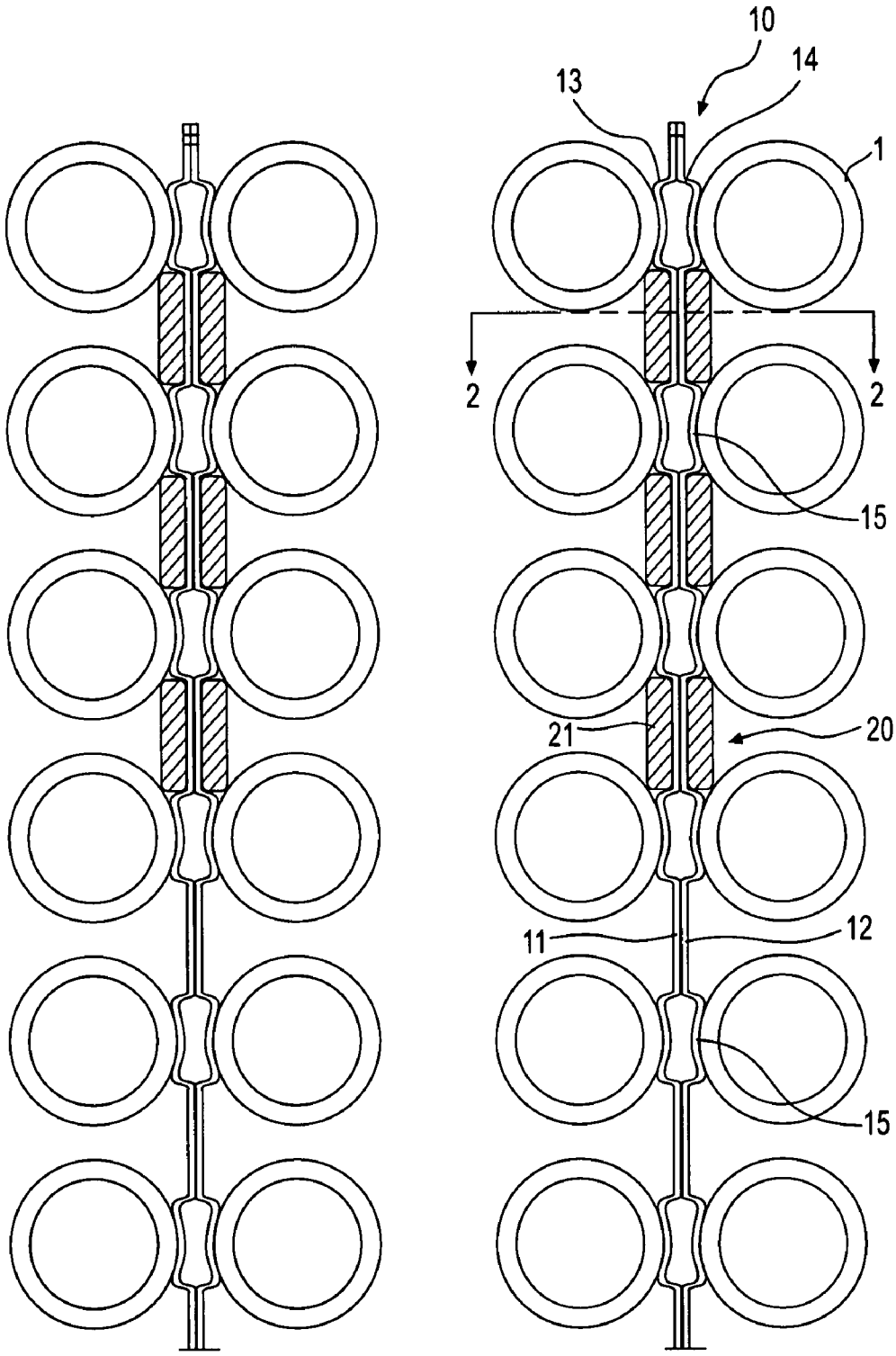
FIG. 1 is a cross-section of elongated members having a support device located therebetween with a locking arrangement in accordance with one aspect of the present invention.

FIG. 1 illustrates a portion of a bundle of elongated members 1. The elongated members 1 are arranged in rows with a space or lane separating adjacent rows of members 1. The elongated members 1 preferably form part of a fluid handling device. The fluid handling device is preferably a heat transfer device such as, for example, a heat exchanger. The elongated members 1 may be rods or hollow tubes that are capable of transferring heat to a fluid flowing through the device. The rods or hollow tubes may be part of a shell and tube heat exchanger or other suitable heat transfer assembly (whether for heating or cooling). As described above, the elongated members 1 may experience or be subject to vibration as a result of fluid flow in and around the elongated members 1.

In order to mitigate vibration and improve performance, at least one support device 10 may be inserted in the lane between adjacent rows of elongated members 1, as shown for example in FIG. 1. The support device 10 comprises an elongated flat member made up of two strips 11, 12. The strips 11 and 12 are preferably formed from a metal that can withstand the temperatures within the heat transfer assembly. The strips 11 and 12 may be joined together using resistance welds or other suitable fastening techniques. The support devices 10 are configured to be inserted in the tube lanes such that the plurality of support members 13, 14 are positioned to engage adjacent tubes 1. The support members 13 are formed by strip 11 and the support members 14 are formed by the strip 12. The support members 13, 14 are created on the face of the two strips 11, 12. Each support member has an arcuate elongated member-receiving saddle 15, which is sized to receive a portion of the elongated member therein. Each support device 10 is preferably inserted into the bundle within a lane so that the tubes or rods on either side of lane receive support from the support device. The arcuate saddles 15 receive and cradle the tubes, provide support and reduce their propensity to vibration while imposing only a minimal restriction of flow parallel to the tubes.

When the support devices 10 are inserted into the bundle of elongated members, the raised support members 13, 14 have to be pushed past the elongated members until the support device 10 is in its proper place in the bundle, such that the elongated members 1 are accommodated in corresponding saddles 15 on the support members 13 and 14. Each support member has to be pushed through the gap or lane between each pair of opposed tubes until the support device is in place. Because the total depth of the support members is preferably slightly greater than the spacing between elongated members, the elongated members have to bend slightly to let the saddles pass, although this maintains the support in place when it is in its final position.

Figure 2:
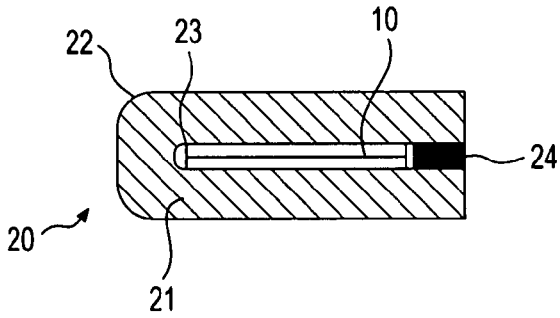
FIG. 2 is a cross-sectional view one configuration of the support device and locking arrangement along section line 2-2 in FIG. 1.

While the frictional engagement between the support devices 10 and the elongated members 1 will provide for retention of the support devices 10 in the bundle, the support devices 10 are preferably fixed into place using at least one locking assembly 20, shown in FIGS. 1 and 2. Each locking assembly 20 includes at least one locking block 21 that is secured to the support device 10. The locking block 21 is preferably sized to be received within the space between adjacent support members 13 and adjacent support members 14. As shown in FIG. 1, the thickness of the locking block 21 is greater than the depth of the support members 13 and 14. With such arrangement, the elongated members 1 cannot be inadvertently removed from saddles 15 on the support members 13, 14. As such, the support devices 10 can be maintained within the bundle without the need of additional securing devices such as cables extending around the periphery of the bundle.

As shown in FIG. 1, each support device 10 may include as many as three locking assemblies 20. The locking assemblies are preferably positioned on the support device 10 adjacent the end of the device, which is oriented near the outer perimeter of the bundle and is effective in preventing the inadvertent removal of the locking assemblies 20. The present invention, however, is not intended to be limited to the use of three locking assemblies; rather, it is contemplated that less than three or more than three may be employed provided the number of locking assemblies is sufficient to prevent inadvertent removal of the support device 10 from the bundle. For instance, a locking assembly 20 may be provided in the spacing between each of the adjacent support members 13, 14. It is also contemplated that the locking assemblies 20 may be provided at spaced locations along the device 10. The use of the locking assembly eliminates the difficulties associated with the use of the cable, described above, while reducing the time needed to install the devices.

The generally U-shaped locking block 21 of the locking assembly 20 preferably has rounded edges 22, as shown in FIG. 2, to reduce any detrimental impact of the locking block 21 contacting the elongated members 1. One possible configuration of the locking block 21 includes a slot 23, which is sized to receive strips 11 and 12 therein. The locking block 21 may be secured to the device 10 through a weld 24, as shown in FIG. 2. The present invention, however, is not intended to be limited to the use of welds; rather, other suitable fastening mechanisms are considered to be well within the scope of the present invention.

The operation of the support device 10 in connection with the locking assembly 20 will now be described in greater detail. The locking assemblies 20 are located and secured to the support device 10 at select locations along the support device 10. The locking assemblies 20 are located adjacent or near one end of the strips 11 and 12. Preferably, the locking assemblies 20 are located adjacent or in the vicinity of one end of the strips 11 and 12, which are located near the outer periphery of the tube bundle, as shown in FIG. 1. This location of the locking assemblies 20 is sufficient to secure the support device 10 in place to prevent its inadvertent removal.

When the support devices 10 are inserted into the bundle to reduce vibration, as described in co-pending U.S. patent application Ser. No. 11/128,884 to Wanni et al., the elongated members 1 contact the tube-receiving saddles 15 causing the elongated members 1 to flex as the saddles 15 pass the elongated members 1 until the device 10 is properly located within the bundle. When the tube support device 10 is properly positioned within the bundle, the tubes 1 rest in the tube-receiving saddles 15, as shown in FIG. 1. The locking assemblies 20 are positioned between adjacent elongated members 1. In the event that a lateral or shifting force is applied to the support devices 10, the locking assemblies 20 come into contact with the adjacent elongated member 1 to maintain the proper position of the support device and prevent inadvertent removal or inadvertent displacement of the support devices 10.

Figure 3:
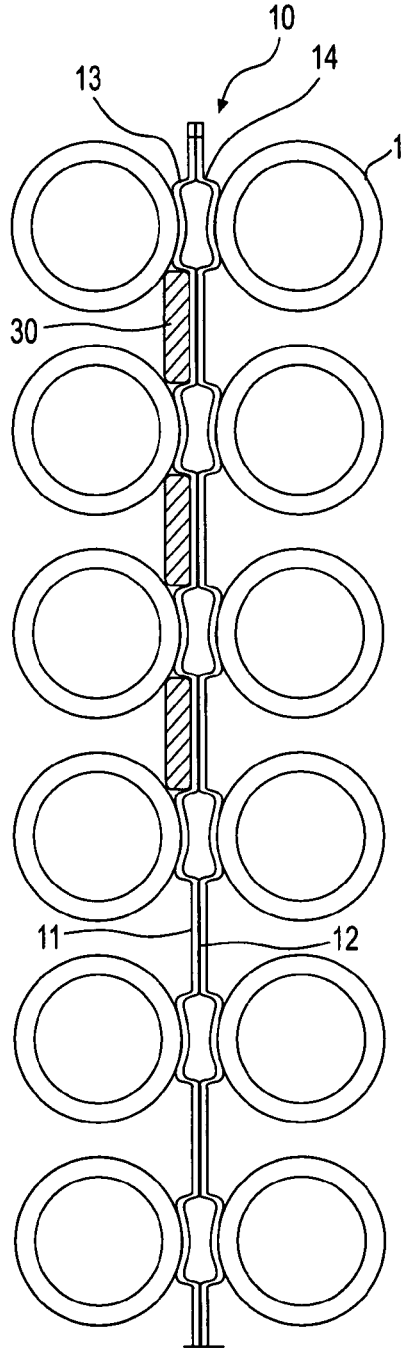
FIG. 3 is a cross-section of elongated members having a support device located therebetween with a locking arrangement in accordance with another aspect of the present invention.

A variation of the locking assembly is illustrated in FIG. 3. The locking assembly 30 is located and secured to the support device 10 at select locations along the support device. The locking assembly 30 includes a block or wedge that is secured to one side of the support device 10. The block may be welded or secured to the support device using other suitable fastening mechanisms. The operation of the support device 10 in connection with the locking assembly 30 will now be described in greater detail. The locking assemblies 30 are located and secured to the support device 10 at select locations along the support device 10, as shown in FIG. 3. Like locking assemblies 20, the locking assemblies 30 are located adjacent or near one end of the strips 11 and 12. Preferably, the locking assemblies 30 are located adjacent or in the vicinity of one end of the strips 11 and 12, which are located near the outer periphery of the tube bundle. This location of the locking assemblies 30 is sufficient to secure the support device 10 in place to prevent its inadvertent removal. In FIG. 3, the locking assemblies 30 are located along the same side of the support device. The present invention is not intended to be so limited; rather, it is contemplated that the locking assemblies may be located on opposing sides of the support device 10 such that a first locking assembly 30 may be located on one side of the device 10 and the second locking assembly 30 is located spaced from the first locking assembly on an opposing surface of the support device.

It will be apparent to those skilled in the art that various modifications and/or variations may be made without departing from the scope of the present invention. It is contemplated that the present invention is not intended to be limited to the support device 10 described herein; rather, it is intended that the locking assembly 20 may be used with other suitable support devices, as disclosed for example in U.S. Pat. No. 7,032,655 to Wanni et al., U.S. Pat. No. 7,117,935 to Wanni et at., and U.S. Pat. No. 7,128,130 to Wanni et al., wherein the locking assemblies 20 may be positioned between adjacent sets of tube engaging zones. It is intended that the present invention covers the modifications and variations of the method herein, provided they come within the scope of the appended claims and their equivalents.

What is claimed is:

1. A support device for a bundle of elongated members, wherein the bundle of elongated members including a plurality of spaced rows of elongated members, wherein the support device comprising:

an elongated support adapted to be located between adjacent spaced rows of elongated members, wherein the elongated support has a first side and a second side, wherein the first side is being arranged to be positioned adjacent one row of the spaced rows of elongated members and the second side being arranged to be positioned adjacent another row of the spaced rows of elongated members;

a plurality of support members spaced along the elongated support, wherein each support member has a first supporting assembly located on the first side of the elongated support for supporting one of the elongated members in the one row and a second supporting assembly located on the second side of the elongated support for supporting one of the elongated members in the other row; and at least one locking assembly for locking the support device between the adjacent rows of elongated members, wherein each of the at least one locking assembly is being located on at least one of the first side of the elongated support and the second side of the elongated support between adjacent supporting assemblies, wherein the locking assembly is being sized to contact the elongated members on adjacent supporting assemblies.

2. The support device according to claim 1, wherein each of the at least one locking assembly is being located on the first side and the second side of the elongated member, such that a portion of the locking assembly is being positioned between adjacent first supporting assemblies on the first side and adjacent second supporting assemblies on the second side.

3. The support device according to claim 2, wherein each locking assembly comprises a block having a slot formed therein, wherein the slot is being sized to receive a portion of the elongated support therein.

4. The support device according to claim 3, wherein the block is secured to the elongated support.

5. The support device according to claim 3, wherein the block has edge surfaces constructed and arranged to contact adjacent elongated members.

6. The support device according to claim 5, wherein the edge surfaces are rounded.

7. The support device according to claim 5, wherein each of the support members has a first thickness and each of the locking assemblies has a second thickness, wherein the second thickness is greater than the first thickness.

8. The support device according to claim 1, wherein the elongated support has a length, wherein the plurality of support members are being spaced along substantially the entire length of the elongated support.

9. The support device according to claim 8, wherein the bundle of elongated members has an interior and an outer periphery, wherein the elongated support has a first end adapted to be located in the vicinity of the outer periphery, wherein the at least one locking assembly is being located adjacent the first end.

10. The support device according to claim 1, wherein each of the at least one locking assembly has being located on only one side of the elongated support, such that a portion of the locking assembly is being positioned between adjacent supporting assemblies on one side of the elongated support.

11. The support device according to claim 10, wherein the locking assembly comprises a block secured to the elongated support.

12. The support device according to claim 11, wherein the block has edge surfaces constructed and arranged to contact adjacent elongated members.

13. The support device according to claim 12, wherein the edge surfaces are rounded.

* * * * *